US006122917A

United States Patent [19]

Senior

[11] Patent Number: 6,122,917

[45] Date of Patent: Sep. 26, 2000

[54] HIGH EFFICIENCY HEAT TRANSFER STRUCTURE

[75] Inventor: Peter Senior, Leicester, United Kingdom

[73] Assignee: Alstom Gas Turbines Limited, United Kingdom

[21] Appl. No.: 09/103,605

[22] Filed: Jun. 24, 1998

[30] Foreign Application Priority Data

Jun. 25, 1997 [GB] United Kingdom ..... 9713366

[51] Int. Cl.[7] ..... F02C 7/12

[52] U.S. Cl. ..... 60/752; 60/760; 415/914; 165/908

[58] Field of Search ..... 60/752, 755, 756, 60/759, 760; 415/914; 165/908

[56] References Cited

U.S. PATENT DOCUMENTS 2,052,869 9/1936 Coanda ..... 299/107 X 5,533,864 7/1996 Nomoto et al. ..... 416/96 A X 5,586,866 12/1996 Wettstein .

*Primary Examiner*—Timothy S. Thorpe

*Assistant Examiner*—Ehud Gartenberg

*Attorney, Agent, or Firm*—Kirchstein, et al.

[57] ABSTRACT

A heat transfer structure for the efficient cooling of a heated surface such as the combustor wall of a gas turbine has a high heat transfer coefficient and can therefore operate at a relatively low pressure loss. A cooling jacket is formed around the heated surface by means of an apertured wall parallel to and spaced from the heated surface. Cooling fluid such as air flows into the cooling jacket through the apertures and impinges as air jets on the heated surface. The heat transfer coefficient is greatly increased by flow diversion features associated with the apertures which act as Coanda surfaces to divert the air jets so that they impinge obliquely and turbulently on the heated surface and establish subsequent turbulent sinuous cross-flows of the cooling air on the heated surface.

9 Claims, 2 Drawing Sheets

HIGH EFFICIENCY HEAT TRANSFER STRUCTURE

FIELD OF THE INVENTION

The invention relates to heat transfer structures for establishing efficient heat transfer between a solid surface and a fluid, particularly between a solid surface and a gas. The invention has been conceived in the context of the need to establish more efficient cooling of the combustors of large capacity gas turbines used in electrical generation, and the invention will be described with particular reference to that field of use. The invention is however general in application and is in no way limited to combustors. For example, it is also applicable to turbine components.

BACKGROUND ART

Electrical power generators using gas turbines as the motive power source are well known. The gas turbines used to power such generators typically have power outputs of from 1.6 megawatts to over 200 megawatts. In use, the temperature of the combustion gases in the combustor generally exceeds the melting point of the metal alloy from which the combustor is made, and particularly efficient cooling of the combustor walls is a necessary requirement, to prevent melting of the combustor.

Four basic methods of cooling combustor walls, or walls of other hot components, are in common use. These are as follows:

Film Cooling.

Cooling air flows through one or more rows of holes in the wall and spreads over the hot side of the wall as a thin film of cooling air. Film cooling may be applied over the entire inner wall of a combustor. Disadvantages are that the efficiency of combustion is impaired by the passage of cooling air to the inside of the combustor. Some of that air inevitably mixes with the combustion gases and lowers the combustion reaction zone temperature, quenching the reaction and increasing pollutant emissions. There is a loss of efficiency, and it is in general necessary to maintain a low mass flow of cooling air in order to maximize the air available for combustion and thereby reduce primary pollutant emissions.

Impingement Cooling.

A perforated cooling jacket is provided around the combustor wall, to define therebetween a heat exchange chamber. Adequate heat exchange is created by establishing a very rapid flow of cooling air or other gaseous coolant through the perforations, so producing small jets of coolant which impinge upon the outside of the combustor wall. An advantage of impingement cooling is that it can be used with a relatively low mass flow of air with correspondingly high pressure loss, so maximizing the air available for combustion. The air is commonly reintroduced downstream of the reaction zone, thereby also reducing quenching pollutants. Hence this type of cooling outperforms film cooling where pollutant emissions are critical. Furthermore, correct design can ensure low sensitivity to manufacturing and other tolerances.

Convection Cooling.

A cooling jacket is provided around the combustor, to define a heat exchange chamber between the jacket and the combustor outer wall. The heat exchange chamber has a hot wall, which is the outer wall of the combustor, and a cool wall, which is the wall of the cooling jacket. Adequate heat exchange between the wall and coolant is created purely by establishing a rapid flow of cooling air through the chamber.

The dimensions of the system are relatively small, so requiring high accuracy components. This is costly and the cooling performance is sensitive to manufacturing or installation tolerances and movement during operation. The system offers the advantage of relatively low pressure loss and so the cooling air can be re-used for combustion without excessive efficiency penalty, thereby avoiding the pollutant effects associated with the first two types above.

Enhanced Convection Cooling.

A cooling jacket is provided around the combustor, to define therebetween a heat exchange chamber. The hot wall is provided with fins extending into the heat exchange chamber, and a current of cooling air is passed over those fins. Thermal transfer between the cooling air and the fins provides the cooling necessary. Typical dimensions are larger than equivalent plain convection cooling, reducing the sensitivity to tolerances. However, a major disadvantage of this heat exchange structure is that the fins have to be provided on the hot combustor wall, which is typically made from a high specification and expensive alloy. The cost of forming that alloy into a finned surface is correspondingly high. Furthermore, the thermal gradients induced by non-uniform thickness of the combustor wall are detrimental to the operating life of the combustor, as are the stress-concentrating properties of the fins.

SUMMARY OF THE INVENTION

It is an object of the invention to overcome disadvantages associated with the above prior art heat transfer structures and to provide a heat transfer structure which operates efficiently over a range of mass flow conditions and a range of pressure losses.

The invention provides a heat transfer structure comprising:

- a heated surface from which heat must be removed by a coolant;
- outer wall means having an inner surface confronting and spaced from the heated surface and an outer surface which acts as a boundary of a plenum chamber containing pressurized coolant;
- coolant inlet means;
- coolant outlet means;
- the coolant inlet means comprising an array of apertures in the outer wall means for generating a corresponding array of jets of coolant for impingement on the heated surface, thereby establishing a flow of coolant from the plenum chamber into the heat transfer structure and over the heated surface to the coolant outlet means; and
- flow diversion means associated with each of the apertures in the outer wall means to divert the impingement jets and establish an oblique impingement of the coolant fluid upon the heated surface, the heat transfer performance of the structure being augmented by interaction of the coolant with successive flow diversion means as it flows towards the coolant outlet means after its initial impingement on the heated surface.

It is significant that the flow diversion means are provided on the outer wall rather than on the heated surface. The heated surface is generally made of a high specification alloy which is difficult and expensive to form, but the apertured wall may be made from stainless steel or low alloy sheet. It is therefore cheaper by far to form the baffle means on the steel or alloy sheet, which can be shaped by stamping.

Preferably the flow diversion means are formed as Coanda effect surfaces which induce a reduction in the air pressure on one side of the associated apertures relative to that at the opposite side of the apertures, so as to induce a deflection of the turbulent jets of coolant fluid in the direction of the said one side. The obliquely impinging jets so generated are highly turbulent and make excellent thermal contact with the heated surface. This represents a highly efficient heat exchange system.

Each flow diversion means may be produced by pressing a shaped dimple into the outer wall from its outer surface, the underside of the dimple thereby projecting from the inner surface of the outer wall immediately adjacent a respective aperture. If the apertures comprise short slots through the outer wall, the flow diversion means are preferably aligned to divert the turbulent coolant jets in a direction at right angles to the longitudinal axes of the slots.

The array of apertures preferably comprises a plurality of rows of such apertures, the apertures in each row being equally spaced apart. Preferably the apertures in each row are offset from the apertures in the adjacent rows. This staggering of the apertures in adjacent rows means a more even cooling of the entire heated wall, since after impingement the coolant travels in a generally sinuous vortical flow path around the various successive flow diversion means on its way to the coolant outlet, thereby enhancing turbulent heat transfer in these areas. The sinuosity of the path may be increased by closer spacing of the rows but decreased by increasing the number of rows before the stagger or offset cycle is repeated.

In the context of a gas turbine engine combustor, the heated surface of the above heat transfer structure is the combustor wall and the coolant is pressurized air, which may conveniently be bled off from a compressor in the engine and passed to a plenum chamber defined between the combustor and surrounding engine structure. Even assuming the combustor wall is made of heat resisting nickel-based alloy, efficient heat transfer away from the combustor wall is needed to avoid melting of the wall at peak load conditions of the gas turbine. The heat transfer structure is completed by putting a cooling jacket, i.e., the outer wall, around the combustor and passing cooling air from the plenum chamber into that cooling jacket through the apertures in the outer wall. A turbulent flow of air over the outer surface of the combustor wall is established by means of the flow diversion means which are pressed into the outer wall. The heat transfer coefficient of the arrangement is particularly high, and efficient cooling of the combustor wall can be established without an excessively high pressure loss. If the coolant outlet means is connected to an air inlet of the combustor, the hot air exhausting from the cooling jacket can then advantageously be used as preheated combustion air in the combustor. The augmentation of heat transfer by the sinuous cross-flow of the cooling air also reduces temperature gradients in the hot wall which has a beneficial effect on combustor life.

It will be understood that the same principle of construction can be used for cooling the hot surfaces of the turbines of the same gas turbines.

The coolant fluid is not necessarily air or even a gaseous coolant. For instance, steam or steam and air mixtures can also be used to cool gas turbine engines, particularly in combined cycle plants, and steam or steam and air mixtures can be fed into the combustion process to help control combustion temperatures. In other applications the same principles of construction can be used to establish a turbulent sinuous flow of liquid coolant across a surface to be cooled, after initial impingement on the surface.

BRIEF DESCRIPTION OF THE DRAWINGS

Exemplary embodiments of the invention will now be described with reference to the accompanying drawings, in which.

DETAILED DESCRIPTION OF THE PREFERRED EMBODIMENTS

Figure 1:
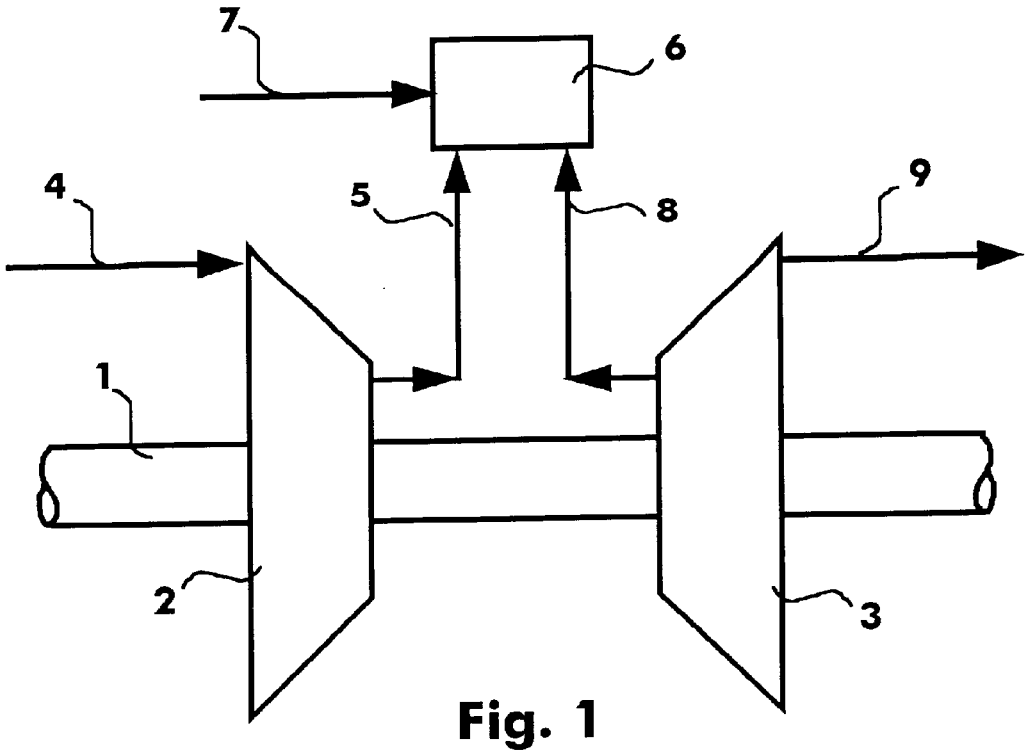
FIG. 1 is a schematic layout diagram of a gas turbine.

Referring first to FIG. 1, there is shown in schematic form a conventional layout of a gas turbine. A shaft 1 mounts a compressor 2 and a turbine 3. Intake air is drawn into the compressor 2 at 4, compressed, and delivered at 5 to a combustor 6. Fuel is also delivered to the combustor 6 at 7, and the hot combustion gases are delivered at 8 to the turbine 3 which is driven by those gases. 9 indicates the exhaust flow from the turbine 3.

All of the above is conventional, and is included to illustrate the need for efficient cooling of the walls of the combustor 6 and of the turbine 3. In each case the alloy used in the construction of the relevant surfaces exposed to the hot combustion gases would melt or distort excessively if the surfaces were not adequately cooled.

Figure 2:
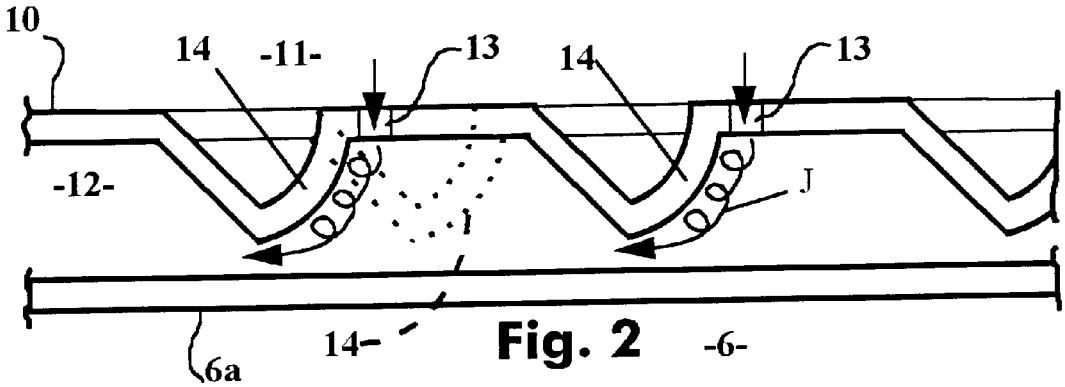
FIG. 2 is a section through a part of the combustor wall of the gas turbine, showing details of the heat transfer structure of the invention.

FIG. 2 illustrates details of a cooling jacket formed around the wall of the combustor 6. The combustor wall is denoted 6*a,* and is surrounded by an outer apertured wall 10 which in turn is surrounded by a plenum chamber 11. An outer wall of the plenum chamber 11 is not shown. Between the apertured wall 10 and the combustor wall 6*a* is formed a cooling chamber 12, and it is a feature of the invention that a particularly efficient heat exchange between the cooling air in the chamber 12 and the heated surface 6*a* is established and maintained.

The efficient cooling is achieved by establishing turbulent cross-flows of air through the cooling chamber 12. Air passes into the cooling chamber 12 as turbulent jets J through an array of apertures 13. Immediately adjacent each aperture 13 is a curved Coanda surface of a flow diversion feature or "baffle" 14. The Coanda surface diverts the jets J from perpendicular impingement on the surface of wall 6*a* by inducing a lateral component of movement in them as they enter the cooling chamber 12. The diverted jets J have enhanced turbulence, as indicated generally by the spiral arrows depicting them. As the diverted jets J impinge on the surface 6*a,* the resulting scrubbing action of the jets on the surface obtains a high heat transfer coefficient. However, the accompanying pressure loss is reasonably low.

Figure 3:
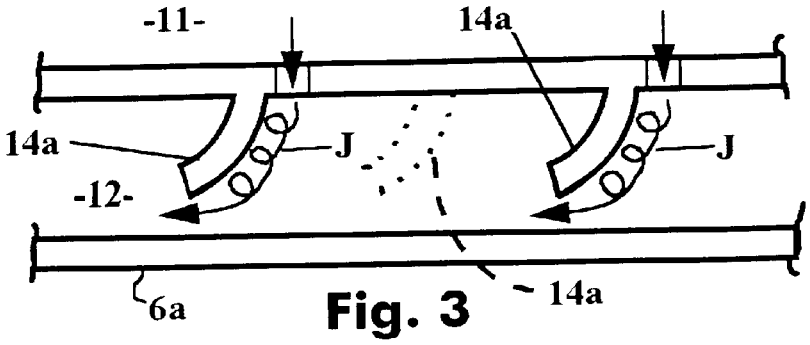
FIG. 3 is a section similar to that of FIG. 2 but showing a different shape and construction of flow diversion features.

FIG. 2 illustrates, by means of a dotted line, the preferred offset distribution of the apertures 13 and baffles 14 in adjacent rows of apertures in the array. The baffles 14 of FIG. 2 are formed merely by pressing shaped dimples into the apertured wall. FIG. 3 illustrates, however, that such a pressing operation, although economical, is not the only way of creating the baffle structure. The baffles 14*a* of FIG. 3 present similar Coanda surfaces which could be formed by cutting small strips of metal from a sheet, bending them to shape, and spot-welding or brazing them to the apertured wall 10. Alternatively, they could be produced by shaping flanges produced integrally with the wall 10. The method of construction is unimportant: what is important is the shape of the baffles, which induce an oblique turbulent impingement of the jets J on the combustor wall, followed by cross-flow of coolant air along the surface of the combustor wall.

Figure 4:
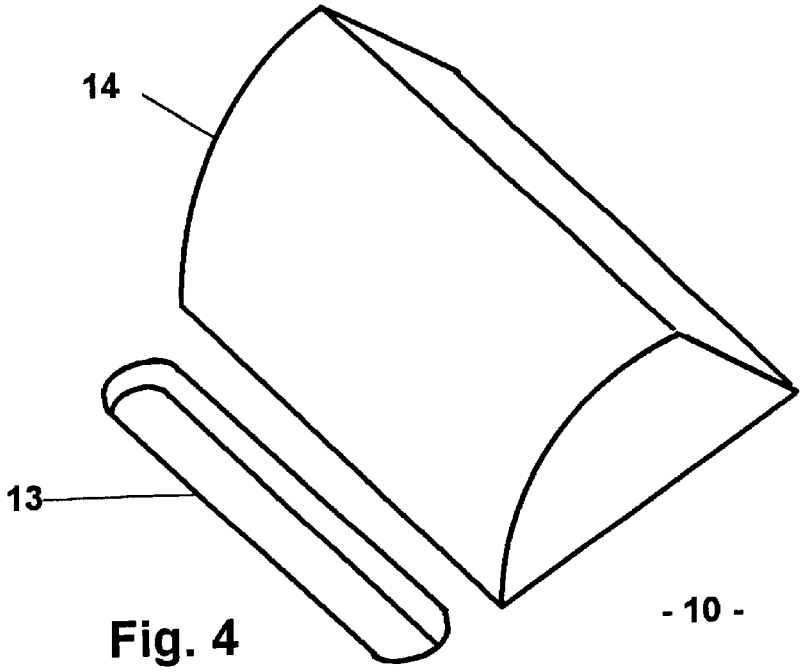
FIG. 4 is a perspective view of one aperture and an associated flow diversion feature in the apertured wall of FIG. 2.

FIG. 4 illustrates the shape of one of the pressed dimples of FIG. 2, viewed from below as it projects from the inner surface of the outer apertured wall adjacent an aperture 13. FIG. 4 also illustrates a preferred shape for the apertures 13, which are advantageously elongated in a direction perpendicular to the induced cross-flow.

Figure 5:
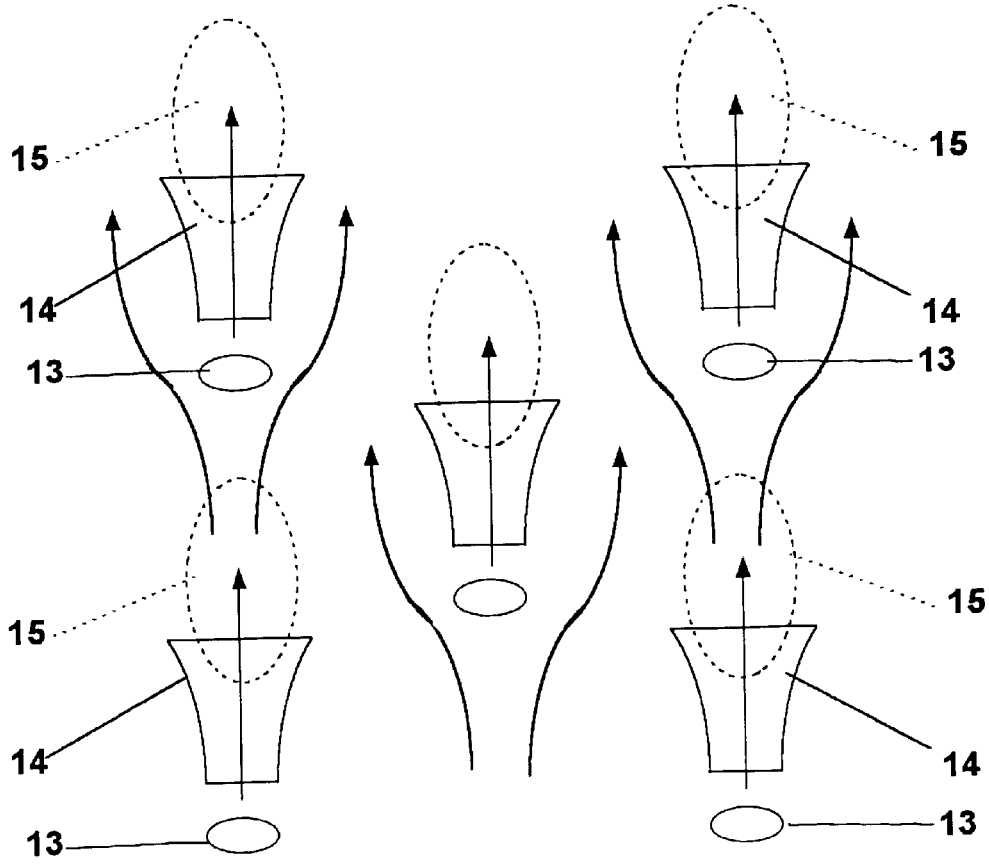
FIG. 5 is a plan view of a two-stagger offset distribution of apertures and baffles in the aperture wall, showing the general path of the cooling air cross-flows.

FIG. 5 illustrates how the main vortex cross-flow travels a sinuous path around the staggered rows of baffles 14. The sinuous nature of that path can be accentuated by placing the rows of offset apertures 13 and baffles 14 closer together or straightened by arranging the rows in a 3-offset or 4-offset array.

FIG. 5 also illustrates the general position of the zones 15 of most efficient heat transfer, shown defined by dotted ellipses. These are the zones of maximum turbulence due to the obliquely impinging jets, which illustrates the advantage of the creation, according to the invention, of air turbulence in the subsequent vortical sinuous flow to enhance the heat transfer coefficient in areas less strongly influenced by the initial impingement zones.

I claim:

1. A heat transfer structure comprising:

an impingement surface from which heat is to be removed by a coolant impinging thereon;

outer wall means having an outer surface which acts as a boundary of a plenum chamber containing pressurized coolant and an inner surface confronting and spaced from the impingement surface to define a cavity between the impingement surface and the outer wall means;

coolant inlet means;

coolant outlet means;

the coolant inlet means comprising an array of apertures in the outer wall means for generating a corresponding array objects of coolant fluid for impingement on the impingement surface, thereby establishing a flow of coolant fluid from the plenum chamber into the heat transfer structure and over the impingement surface to the coolant outlet means; and flow diversion means associated with each of the apertures in the outer wall means to divert the impingement jets and establish an oblique impingement of the coolant fluid upon the impingement surface, wherein each said flow diversion means has an exterior surface which protrudes into the cavity from a location on the inner surface of the outer wall means adjacent an associated aperture, each associated aperture being located outside of the respective flow diversion means to direct the coolant fluid over the exterior surface of the flow diversion means, each said flow diversion means being inclined away from each associated aperture.

2. A heat transfer structure according to claim 1, wherein the flow diversion means are formed as Coanda surfaces each of which induces a reduction in the air pressure on one side of an associated aperture so as to induce the oblique impingement of the coolant fluid.

3. A heat transfer structure according to claim 1, wherein each flow diversion means is formed by pressing a shaped dimple into the outer wall from its outer surface, the underside of the dimple thereby projecting from the inner surface of the outer wall immediately adjacent a respective aperture.

4. A heat transfer structure according to claim 1, wherein each aperture is elongated in a direction which is at right angles to the direction of deflection of the coolant by the flow diversion means.

5. A heat transfer structure according to claim 1, wherein the array of apertures in the outer wall comprises a plurality of rows of such apertures, the apertures in each row being equally spaced apart.

6. A heat transfer structure according to claim 1, wherein the apertures in each row are offset from the apertures in the adjacent rows.

7. A heat transfer structure according to claim 1, in which the heated surface of the heat transfer structure is a wall of a combustor in a gas turbine engine, the coolant is pressurized air, the plenum chamber is defined between the combustor and surrounding engine structure, the outer wall comprises a cooling jacket around the combustor and cooling air can pass from the plenum chamber into the cooling jacket through the apertures in the outer wall.

8. A heat transfer structure according to claim 7 in which the coolant outlet means is connected to an air inlet of the combustor, whereby the hot air exhausting from the cooling jacket can be used as preheated combustion air in the combustor.

9. A heat transfer structure for a gas turbine engine combustor, the heat transfer structure facilitating efficient heat transfer away from the combustor and comprising:

a surface to be cooled comprising a wall of the combustor, cooling jacket means spaced from said surface to define a cavity between said surface to be cooled and an inner surface of said cooling jacket means, plenum chamber means surrounding said cooling jacket means, means connecting said plenum chamber means to a supply of pressurized coolant fluid comprising at least one of steam and air, rows of impingement cooling holes in said cooling jacket means for directing jets of coolant fluid from said plenum chamber means onto said surface, flow deflection means associated with each said impingement cooling hole for deflecting said jets of coolant fluid and establishing a turbulent flow of coolant fluid over said surface, said flow deflection means comprising Coanda surfaces each of which induces a reduction in pressure on one side of an associated impingement hole so as to induce oblique impingement of said jets of coolant fluid onto said surface, said impingement cooling holes and associated flow deflection means in each row being offset with respect to impingement cooling holes and flow deflection means in each adjacent row, whereby heat transfer is augmented by induced sinuous cross-flows of cooling air over said surface, and means connecting said cooling jacket to an inlet of said combustor, whereby during operation of said combustor, coolant fluid heated in said heat transfer structure is used in a combustion process, wherein each said flow deflection means has an exterior surface which protrudes into said cavity from a location on said inner surface of said cooling jacket means adjacent an associated impingement cooling hole, each associated impingement cooling hole being located outside of the respective flow deflection means to direct the coolant fluid over the exterior surface of the flow deflection means, each said flow deflection means being inclined away from each associated impingement cooling hole.

* * * * *